US005152276A

United States Patent [19]

Brock et al.

[11] Patent Number: 5,152,276

[45] Date of Patent: Oct. 6, 1992

[54] SEALED GAS BURNER ASSEMBLY

[75] Inventors: Eddie M. Brock; William E. T. Stevens, both of Cleveland; Shelton T. Barnes, Chattanooga, all of Tenn.

[73] Assignee: Maytag Corporation, Cleveland, Tenn.

[21] Appl. No.: 634,525

[22] Filed: Dec. 27, 1990

[51] Int. Cl.[5] ..... F24C 3/00

[52] U.S. Cl. ..... 126/39 E; 126/39 R; 126/39 J

[58] Field of Search ..... 431/266, 258; 126/39 J, 126/39 E, 39 R

[56] References Cited

U.S. PATENT DOCUMENTS

| | | | |
|---|---|---|---|
| 2,960,980 | 11/1960 | Williams et al. | 126/39 J |
| 4,572,154 | 2/1986 | Schweitzer | 126/39 E |
| 4,626,196 | 12/1986 | Stohrer, Jr. . | |
| 4,627,411 | 12/1986 | Mertler | 126/39 E |
| 4,810,188 | 3/1989 | Kwiatek . | |
| 4,846,671 | 7/1989 | Kwiatek . | |
| 5,002,038 | 3/1991 | Riehl | 126/39 R |

*Primary Examiner*—Larry Jones
*Attorney, Agent, or Firm*—Bacon & Thomas

[57] ABSTRACT

A sealed gas burner assembly provides fast spark ignition of the primary air/gas mixture by supporting the electrode in an electrically insulative member that is disposed in a fluid-tight sealing engagement through the electrode aperture of a burner head, whereby ignition is facilitated by providing an ignition port directly adjacent an exterior terminal end portion of the electrode. The burner head has a low profile defined partly by a circumferential curved sidewall which eliminates turbulence in secondary airflow to the burner ports during high burner rates. A venturi tube providing the primary air/gas mixture to the burner and ignition is fully contained within an internal chamber of the burner head. The assembly is detachably secured to the burner opening of a range top through a twist lock engagement therewith, and is also provided with a seal to prevent spillovers from leaking between the assembly and the range top into the burner box.

20 Claims, 4 Drawing Sheets

FIG. 5
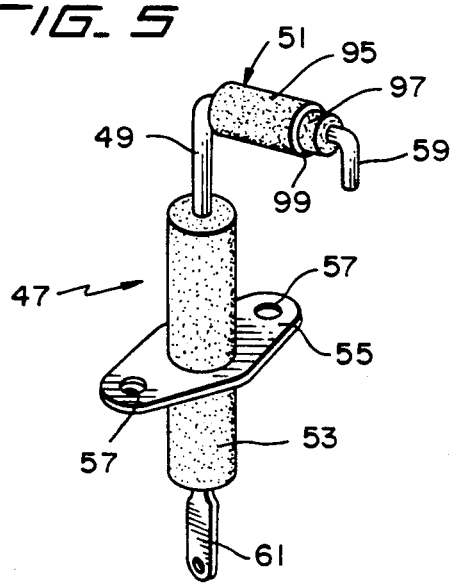
FIG. 7
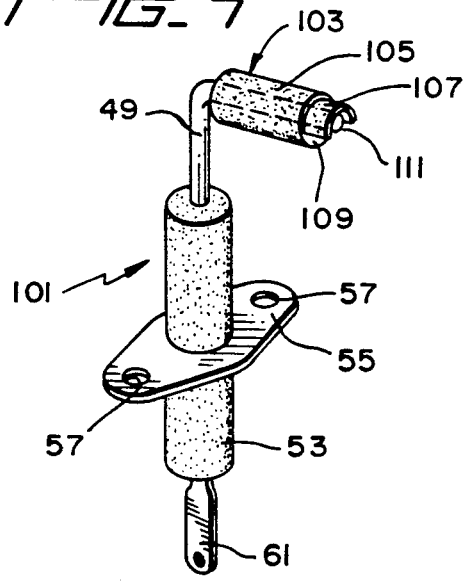
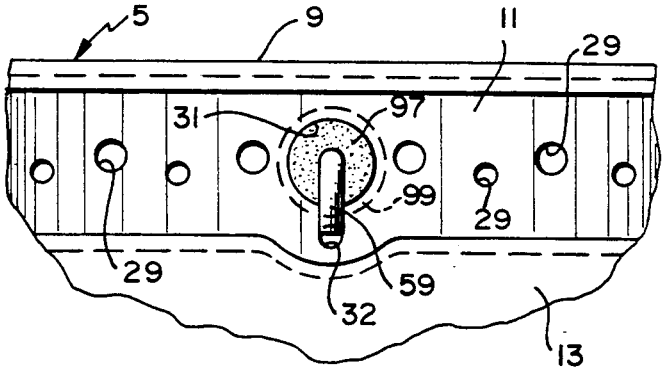
FIG. 6
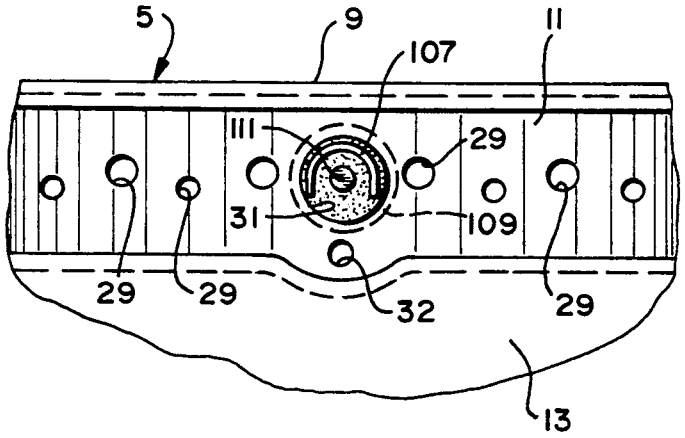
FIG. 8

SEALED GAS BURNER ASSEMBLY

BACKGROUND OF THE INVENTION

1. Field of the Invention

The present invention generally involves the field of technology pertaining to gas burners. More specifically, the invention relates to an improved sealed gas burner assembly provided with spark ignition.

2. Description of the Prior Art

A sealed gas burner assembly is received in the burner opening of a range top and secured in place around the periphery of the opening so that any spillage of food during the cooking process cannot pass between the burner assembly and range top and into the burner box below the range top. This type of burner assembly improves upon earlier known gas burners wherein a large annular spacing exists between the burner head and peripheral edge of the burner opening in the range top. The configuration of a sealed burner assembly provides a clean streamlined appearance which facilitates the cleaning and maintenance of the range top.

A sealed burner assembly typically includes a burner cap provided with a sidewall having a plurality of burner ports formed therein and through which the primary air/gas mixture is passed to the exterior of the cap for combustion. An electrode connected to an appropriate electrical circuit extends through the sidewall of the cap for providing spark ignition of the mixture. The use of spark ignition has become increasingly used because it avoids the extra energy consumption required by a standing igniter pilot flame that is often used to ignite gas range top burners. The electrode may be in the form of a wire which extends upwardly through the base of the burner assembly and supported therein by an electrically insulative member, and outwardly through an electrode aperture in the sidewall of the burner cap within which it is supported by a second insulative support member. The burner cap is electrically conductive and connected to the range top which serves as an electrical ground potential, and the spark electrode is connected to a high voltage potential through the electrical circuit for providing ignition sparks between the electrode and the burner cap. The sparks ignite the primary air/gas mixture passing through the burner ports to create the desired burner flame which is supported by the secondary ambient air.

There are many problems and disadvantages associated with known sealed gas burner assemblies, and particularly those provided with spark igniters. For example, the spark created by the electrode jumps from the electrode to the burner body and ignites the primary air-gas mixture that flows through the spark. This ignition is easily realized in a cast burner head, but more difficult to achieve in a drawn sheet metal burner cap, such as used in a sealed burner assembly, because the main portion of the electrode is contained within the burner head to protect it from food spillovers. Since only the tip of the electrode protrudes out through the electrode aperture of the burner head, there is a tendency for the spark to randomly jump to the burner body in all directions. A known attempt to overcome this problem involves adding gas pathways formed integrally with the electrode body or integral with the aperture through which the electrode protrudes. These gas pathways are so located that during sparking in random directions, the gas will hopefully become ignited within a required period of four seconds. This arrangement is not entirely reliable and the integral gas pathways create a tool maintenance problem.

Moreover, in a traditional sealed burner-type range, the burner head may be assembled to the range top either with or without fasteners. When fasteners are utilized, the burner head is attached to the range top with screws or nuts which provide a more positive sealing engagement, but is inconvenient for cleaning and maintaining the range top. In those models where fasteners are not utilized, a positive engagement between the burner head and the range top cannot be realized to prevent spillage of food from entering into the burner box therebelow.

Furthermore, in a conventional gas burner having an annular hole around the burner head, the secondary air required for proper combustion is drawn through the hole. In a sealed burner assembly, the secondary air is drawn through a gap formed between the range top and the bottom of the pan or utensil resting on the grate above the burner head. It is highly preferred to maintain the height of the grate as low as possible in order to provide an improved appearance. Since the sidewall of a sealed burner head is typically straight and has a high profile, secondary air turbulence is created at increased burner rates, along with the less cosmetically appealing appearance of a higher grate height.

Some examples of known spark ignited sealed gas burner assemblies of the type discussed above are disclosed by the Stohrer, Jr. U.S. Pat. No. 4,626,196, Kwiatek U.S. Pat. No. 4,810,188 and Kwiatek U.S. Pat. No. 4,846,671.

SUMMARY OF THE INVENTION

It is an object of the present invention to provide an improved sealed gas burner assembly.

It is another object of the invention to provide a sealed gas burner assembly having improved spark ignition.

It is a further object of the invention to provide an improved sealed gas burner assembly having a low profile appearance that is cosmetically appealing to the consumer and capable of operating at high burner rates without creating secondary air turbulence.

It is yet another object of the invention to provide an improved sealed burner assembly which is easily and detachably engaged with the burner opening of a range top to provide a fluid-tight seal against food spillovers from entering into the burner box and facilitate cleaning and maintenance of the range top.

It is still a further object of the invention to provide an improved sealed burner assembly which is extremely simple in construction, economical to manufacture and easy to assemble.

It is also an object of the invention to provide an improved spark-ignited sealed gas burner assembly which provides reliable and fast ignition of the primary air/gas mixture.

The foregoing and other objects of the invention are realized by providing a sealed gas burner assembly that includes a burner head formed from a burner cap and a burner base. The head is detachably secured to the burner opening of a range top through a twist lock connection and is provided with a vertical sidewall having a plurality of burner ports formed therein. The head also includes a curved sidewall to provide the head with a low profile and prevent secondary air turbulence during operation of the assembly at high burner rates. A venturi tube is fully contained within an internal chamber of the burner head to supply primary air/-gas mixture to the ports. The vertical sidewall also includes an electrode aperture through which an electrode and an associated insulative support member are disposed in a fluid-tight engagement with the aperture, and an ignition port positioned adjacent an exterior terminal end portion of the electrode for directly supplying the gas mixture thereto in order to achieve fast spark ignition. A sealing member is disposed between the burner head and range top to prevent food spillover from passing downwardly into the burner box below the range top.

Other objects, features and advantages of the invention will become apparent from the following detailed description of preferred embodiments thereof, when taken in conjunction with the drawings wherein like reference numerals refer to corresponding parts in the several views.

FIG. 5 is a perspective view of a first embodiment of an electrode used in the assembly;

FIG. 6 is a partial front elevational view showing the electrode of FIG. 5 installed within the burner head of the assembly;

FIG. 7 is a perspective view of a second embodiment of an electrode used in the assembly; and FIG. 8 is a partial front elevational view showing the electrode of FIG. 7 installed within the burner head of the assembly.

DETAILED DESCRIPTION OF THE PREFERRED EMBODIMENTS

Figure 1:
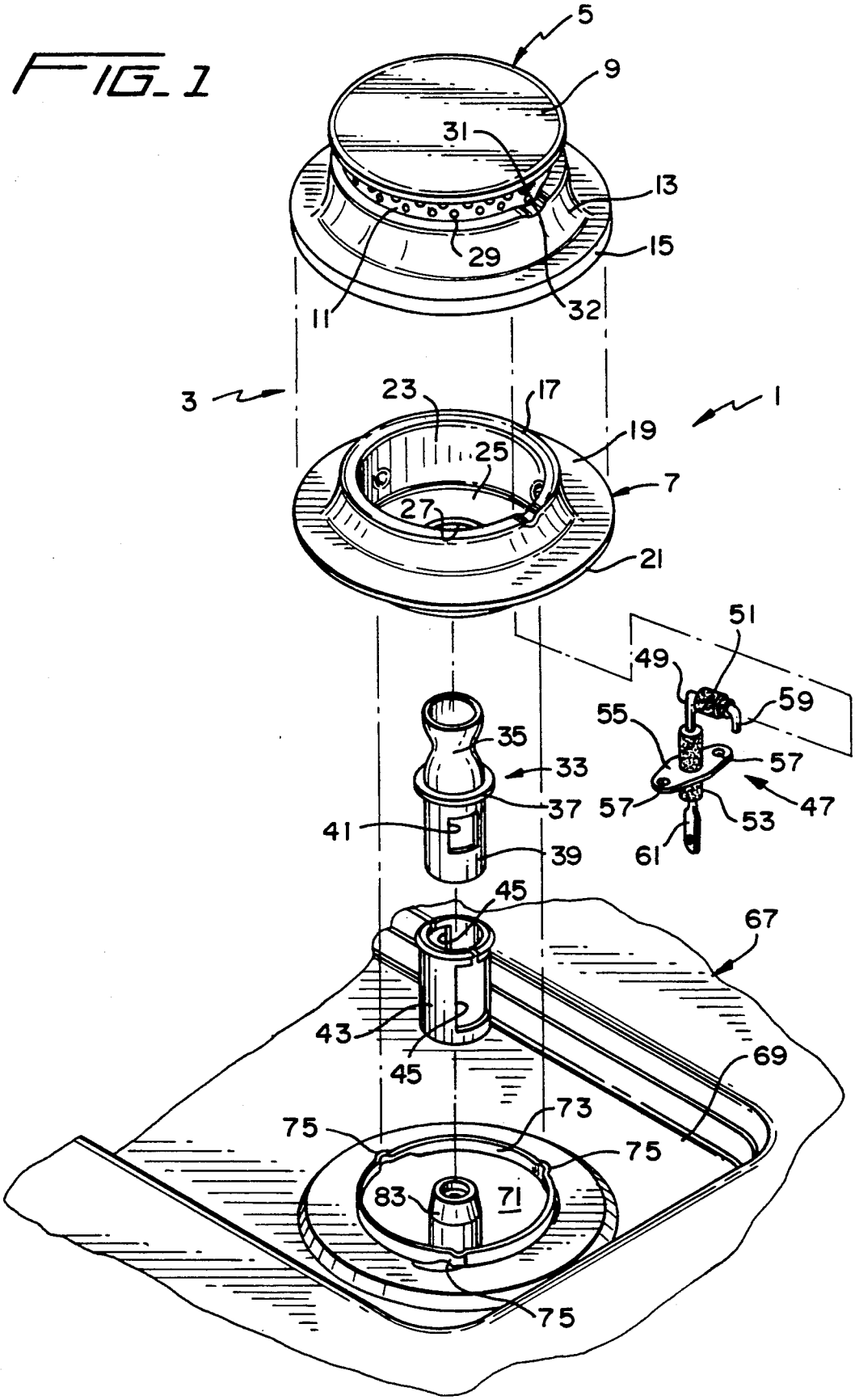
FIG. 1 is an exploded perspective view of a sealed gas burner assembly according to a preferred embodiment of the invention.
Figure 2:
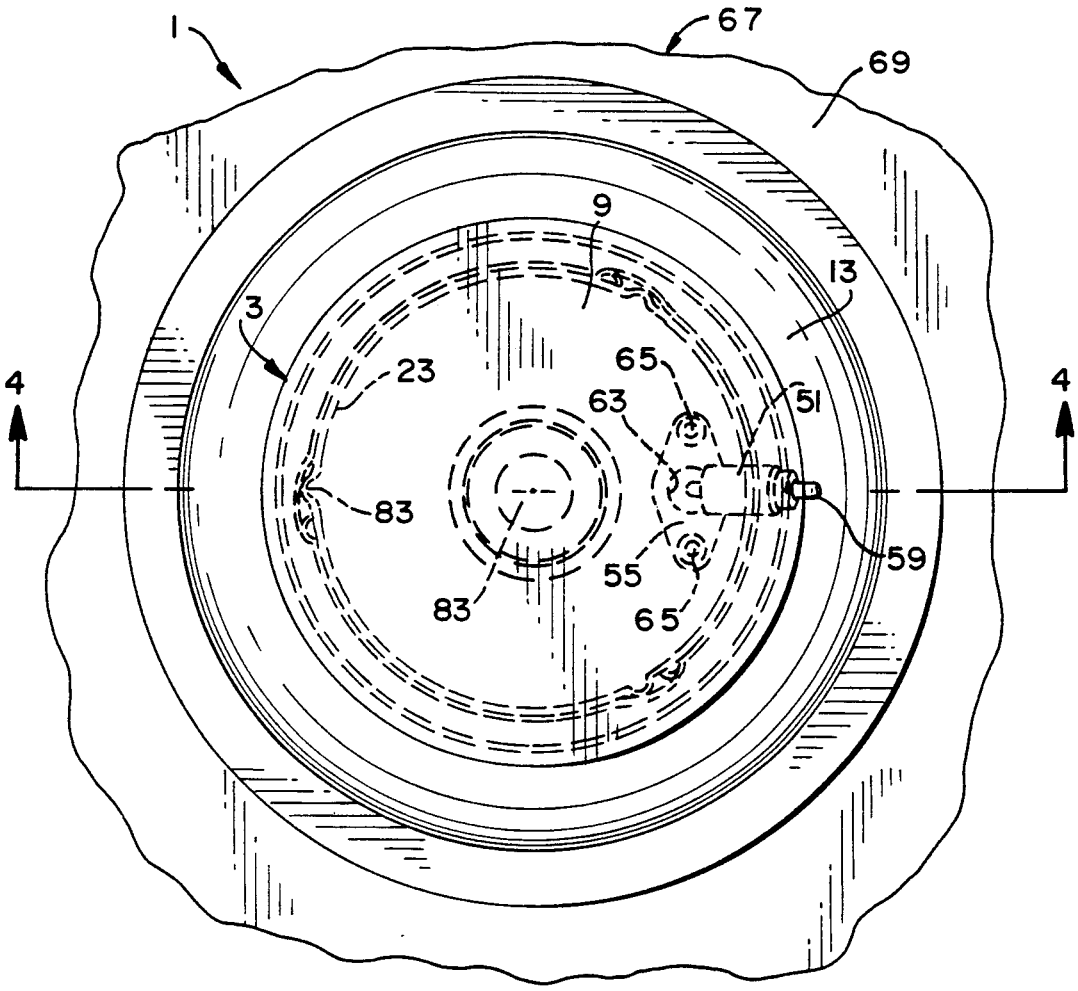
FIG. 2 is a top plan view of the assembly shown in its installed condition.
Figure 3:
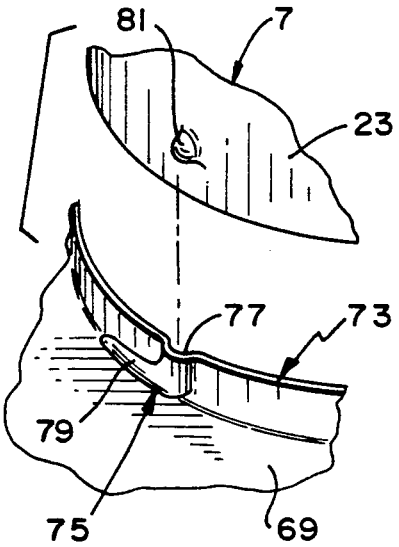
FIG. 3 is a partial perspective view of the twist lock connection between the burner head and burner opening of the range top.

A sealed gas burner assembly 1, according to a preferred embodiment of the invention, shall now be described with initial reference to FIGS. 1–3. As seen in FIG. 1, assembly 1 includes a burner head 3 comprised of a burner cap 5 and a burner base 7. Head 5 and base 7 are each preferably formed from drawn or stamped sheet metal. Head 5 is of a generally circular configuration and includes a flat top 9, a vertical sidewall 11 extending downwardly from top 9, and a curved sidewall 13 that extends downwardly and outwardly from sidewall 11. The outer circumferential edge of sidewall 13 is defined by a downwardly extending circular flange 15.

Burner base 7 is also of a generally circular configuration and is defined by an upper annular rim 17 from which a curved sidewall 19 extends downwardly and outwardly, and terminates in a circumferential edge 21. An inner cylindrical wall 23 extends downwardly from rim 17 and terminates in a circular bottom wall 25 which is provided with a central circular aperture 27 therethrough. The configuration of curved sidewall 19 corresponds to the configuration of curved sidewall 13 so that base 19 may be received within cap 5 and secured thereto by deforming flange 15 of cap 5 inwardly around edge 21 of base 7.

As further seen in FIG. 1, vertical sidewall 11 of cap 5 is also provided with a plurality of burner ports 29 formed therein and circumferentially spaced therearound in a manner and for a purpose to be later detailed. Sidewall 11 also includes an electrode aperture 31 and an ignition port 32 formed therein, with port 32 being positioned directly adjacent to and below aperture 31. Thus, when base 7 is secured to cap 5 by crimping flange 15 around edge 21, an internal chamber of substantially cylindrical configuration is defined therebetween.

As also seen in FIG. 1, there is provided a venturi member 33 which includes a venturi tube 35, an annular ring 37 and a cylindrical tube 39 extending downwardly from ring 37. Tube 39 is provided with a pair of opposed apertures 41 and a cylindrical air shutter 43 which is rotatably and concentrically received on tube 39. Shutter 43 is also provided with a pair of corresponding opposed apertures 45 which are variably alignable with apertures 41 to provide the desired air intake for member 33. As apparent from FIGS. 1 and 2, member 33 is assembled to burner head 3 by inserting venturi tube 35 through aperture 27 of burner base 7 until tube 35 is fully received and enclosed within the internal chamber of head 3. In this position, annular ring 37 abuts the exterior surface of bottom 25 adjacent the peripheral edge aperture 27. Member 33 is secured to base 7 through staking or crimping in a manner to be later described.

Burner assembly 1 also includes an electrode 47 that is defined by an electrical wire 49, a first cylindrical electrically insulative support member 51 and a second cylindrical electrically insulative support member 53, the latter being secured through a mounting bracket 55 provided with a pair of apertures 57 therethrough for receiving appropriate mechanical fasteners. Wire 49 terminates at one end in a downwardly turned portion 59 and at the other end in a terminal blade 61 of appropriate configuration for electrical connection to a conventional ignition circuit. As seen in FIG. 2, electrode 47 is inserted through an aperture 63 formed in bottom wall 25 of base 7 and secured thereto through bracket 55 and a pair of appropriate fasteners 65. End portion 59 of electrode 47 is inserted through electrode aperture 31 of cap 5 and positioned directly adjacent ignition port 32. In this assembled configuration, terminal blade 61 and a portion of second insulative member 53 extends downwardly from bracket 55, the latter being disposed against the exterior of bottom wall 25.

When burner head 3, venturi member 33 and electrode 47 are assembled in the manner described, they collectively form assembly 1 which may in turn be detachably secured to a range top 67. As particularly seen in FIGS. 1 and 3, top 67 includes a recessed burner well 69 provided with a burner opening 71 that is defined by a circular vertical flange 73. A plurality of outwardly extending L-shaped protuberances 75 are formed in flange 73 and equally spaced therearound. Each protuberance 75 includes a vertical recess 77 and a horizontal recess 79. A plurality of corresponding outwardly extending protuberances 81 are formed in cylindrical wall 23 of burner base 7. Protuberances 81 correspond in number and circumferential spacing with protuberances 75 so that assembly 1 may be secured to top 67 by simply engaging protuberances 81 within vertical recesses 77 of protuberances 75 and rotating assembly 1 in a clockwise direction to engage protuberances 81 within horizontal recesses 79. The engagement of protuberances 75 and 81 essentially define a bayonet type connection, thus permitting assembly 1 to be quickly secured to or removed from burner opening 71 of top 67 in a simple twist lock manner. When assembly 1 is secured to top 67 in this manner, a gas inlet nozzle 83 supported in a burner box (not shown) below top 67 is received within cylindrical tube 39 of venturi member 33 for the purpose of supplying gas thereto.

Figure 4:
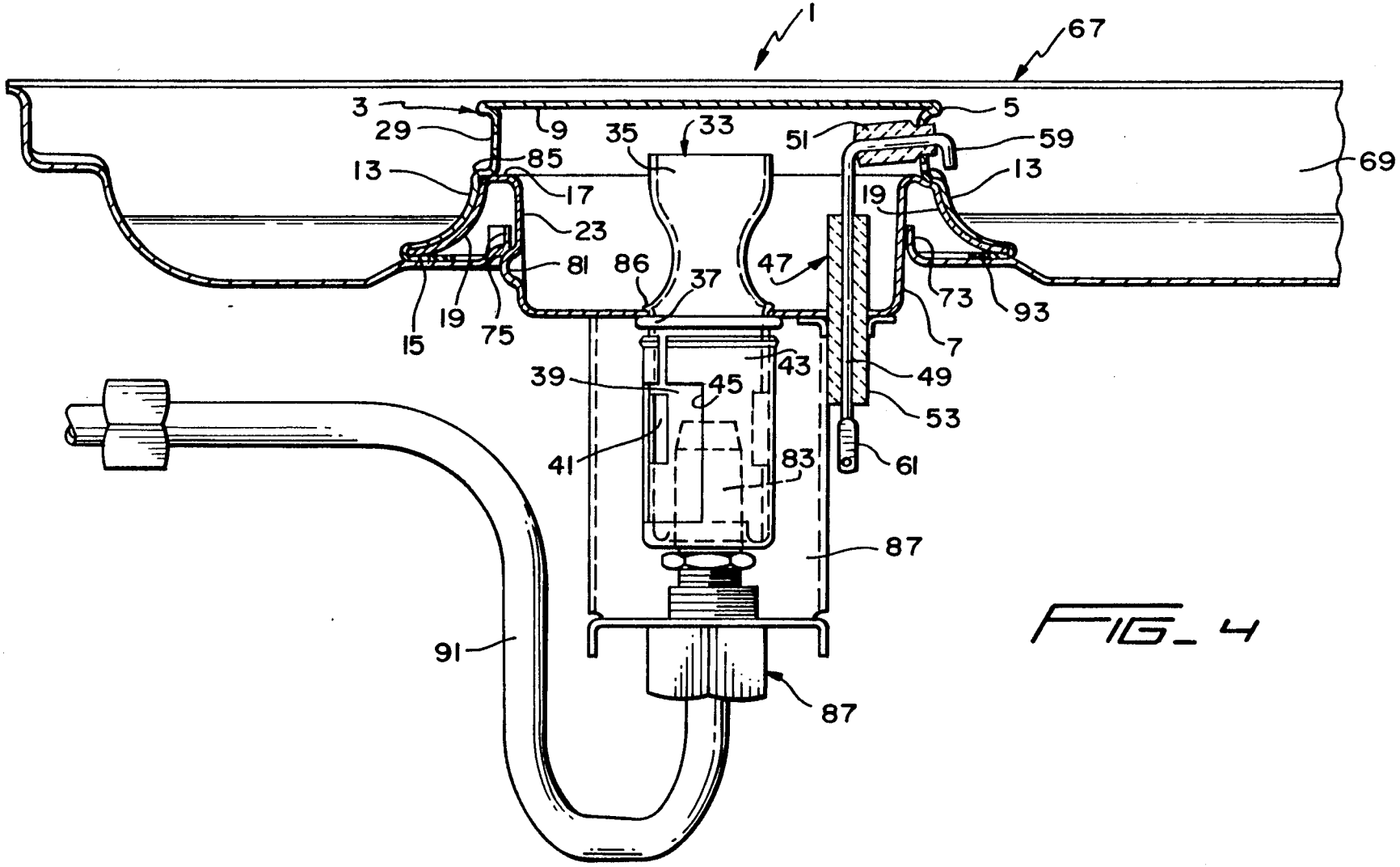
FIG. 4 is a cross sectional view taken along the line 4—4 in FIG. 2.

Burner assembly 1 is shown in its fully assembled form and detachably secured to range top 67 in FIG. 4. As previously indicated, burner head 3 is formed by disposing base 7 within cap 5 and crimping flange 15 inwardly to enclose peripheral edge 21. Curved sidewalls 13 and 19 are disposed in conforming overlying engagement with each other and annular rim 17 engages a horizontal outwardly stepped annular portion 85 of cap 5. Burner head 3 is inserted through burner opening 71 and detachably secured to well 69 of range top 67 through the twist lock interengagement between corresponding protuberances 81 and 75. As also evident in FIG. 4, venturi tube 35 of member 33 is fully contained within the internal chamber of head 3, with member 33 being securely attached to bottom wall 25 through crimping or staking, as indicated at 86. A U-shaped bracket 87 is used to support a conventional gas inlet fitting 89 to which gas inlet nozzle 83 is secured. Fitting 89 receives gas from a gas line 91 which is connected to an appropriate gas source (not shown).

When sealed burner assembly 1 is used for cooking, an appropriate grate (not shown) is supported on rangetop 67 over well 69 and directly above burner head 3. This serves to support the cooking utensil in a spaced manner above top 9 of burner head 3 and thereby permit the flow of secondary air between the bottom of the cooking utensil and top 9. The primary air/gas mixture is received through venturi tube 35 into the internal chamber of burner head 3 for distribution outwardly through burner ports 29 and ignition port 32. Rotation of air shutter 43 relative to cylindrical tube 39 of member 33 permits the establishment of the desired proportions of primary air and gas fed to tube 35.

Because of the sealed configuration of burner assembly 1 relative to range top 67, food spillovers occurring during cooking are normally collected within well 69 and may be removed therefrom due to the lack of direct access to the burner box area below top 67. In order to assure a fluidtight seal between burner head 3 and top 67, it is preferred to dispose an annular sealing member 93 adjacent the outer periphery of head 3. Alternatively, the sealing member 93 may be configured for disposition within the annular junction between cylindrical wall 23 of base 7 and flange 73 of range top 67 so that a fluidtight seal may be realized upon the twist lock engagement of protuberances 75 and 81. Sealing member 93 may be formed from any appropriate material well known in the art, such as rubber or plastic, and deemed suitable for the practice of the invention as disclosed herein.

As particularly apparent from FIG. 4, the structural configuration of burner assembly 1, and particularly the outwardly curved overlying sidewalls 13, 19 of burner head 3, imparts a low profile and large diameter appearance to the latter, and thus permits the use of a grate having a low height. These characteristics significantly improves the cosmetic appearance of assembly 1 for commercial acceptance and also assures its compliance with the regulatory requirements for gas ranges. The curved sidewall configuration of burner head 3 provides a significant advantage in eliminating secondary air turbulence, thereby providing an increased burner rate capacity for assembly 1. This advantage, taken in conjunction with the full enclosure and location of venturi tube 35 within burner head 3 in the low profile configuration, and the arrangement of burner ports 29 in a manner to be later described, permits assembly 1 to operate at increased burner rates as high as 12,000 BTU per hour.

The configuration of electrode 47, its installation and operation relative to burner head 3 shall now be described with reference to FIGS. 5–8. With initial reference to FIG. 5, it shall be seen that first cylindrical insulative member 51 includes a rear portion 95 of larger diameter and a concentric front portion 97 of smaller diameter, thus defining a transverse annular face 99 therebetween. When electrode 47 is installed within burner head 3, as shown in FIG. 6, it is apparent that the diameter of front section 97 is of substantially the same diameter as electrode aperture 31, but sized slightly smaller to permit section 97 to be slidably received therethrough until annular face 99 is disposed in abutting engagement against the interior side of vertical sidewall 11. This serves to define a substantially fluidtight seal between member 51 and aperture 31 to prevent any primary air/gas mixture from passing therethrough. This position of electrode 47 disposes downwardly turned end portion 59 directly in front of ignition port 32 so that when a spark is created between end 59 and burner head 3, the spark is initially confined to the area adjacent ignition port 32 from which the primary air/gas mixture is directly fed to end 59, thereby resulting in a very quick and controlled spark ignition. In this way, the random jumping of the spark from the electrode to other areas of the burner head, such as normally realized in conventional burner assemblies of this type, is avoided. Because of ignition port 32, the conventional forming of integral gas pathways in insulative member 51 and/or aperture 31 so that gas may pass between member 51 and aperture 31, and the tool maintenance problems associated with such known design, are entirely eliminated by the simple and effective arrangement of the present invention.

With reference to FIG. 7, an electrode 101 of a second embodiment is disclosed wherein a first cylindrical insulative member 103 is provided with a rear portion 105 of larger diameter and a downwardly facing insulative front hood 107 of semi-cylindrical configuration. The effective outer diameter of hood 107 is also smaller than the diameter of rear section 105 to define a transverse annular face 109 therebetween. In this embodiment, electrode wire 49 terminates in a straight end portion 111 which is spaced from and enclosed by hood 101. When electrode 101 is installed within burner head 3, as shown in FIG. 8, it can be seen that hood 107 extends through aperture 31 and the external diameter thereof corresponds substantially to, but is slightly smaller than, the diameter of aperture 31. In this way, annular face 109 is disposed in substantially fluidtight engagement against the rear surface of vertical sidewall 11 to prevent any primary air/gas mixture from passing between member 103 and aperture 31. The presence of hood 107 confines the spark to a region between ignition port 32 and end portion 111, thereby preventing the spark from jumping randomly about burner head 3 and resulting in a quick effective spark ignition.

As also evident from FIGS. 6 and 8, burner ports 29 are preferably circular in configuration and arranged in two sets including an upper row of uniform larger diameter ports and a lower row of uniform smaller diameter ports which are circumferentially spaced around vertical sidewall 11 in an alternating manner. The configuration and arrangement of burner ports 29, taken in conjunction with the previously described unique features of assembly 1, also contribute significantly to the increased burner rate now made possible by the present invention.

The terminal blades 61 of electrodes 47 and 103 may be connected to any appropriate known ignition circuit, such as that disclosed by the Stohrer, Jr. U.S. Pat. No. 4,626,196, the entire disclosure of which patent is incorporated herein by reference.

It is also preferred that burner head 3 be provided with an appropriate durable porcelain enamel finish in order to prevent its discoloration due to the higher BTU burner rate applications now made possible by the present invention. The individual components of burner assembly 1 may be formed from any suitable material known in the art and deemed appropriate for the practice of the invention as disclosed herein. Such suitable materials are disclosed by the Kwiatek U.S. Pat. No. 4,810,188 and Kwiatek U.S. Pat. No. 4,846,671, the full disclosures of which patents are also incorporated herein by reference.

Although the present invention has been described herein with regard to details of the preferred embodiments thereof, it shall be understood that changes in form, size, shape, composition and arrangement of parts may be made by one of ordinary skill in the art without departing from the invention, wherein the spirit and scope thereof are defined in the appended claims.

We claim:

1. A sealed gas burner assembly of the type including an electrically conductive burner cap having a sidewall provided with a plurality of burner ports and an electrode aperture, means for supplying a primary air/gas mixture to the burner ports, an electrically insulative support member mounted in the electrode aperture and provided with an electrode passageway therethrough, a spark electrode extending through the electrode passageway and completely surrounded by the support member, and the spark electrode including a terminal end portion disposed exteriorly of the support member, wherein the improvement comprises means for maintaining a substantially fluid tight engagement between the support member and the electrode aperture to prevent the primary air/gas mixture from passing through the aperture.

2. The burner assembly of claim 1 further including an ignition port formed in the sidewall of the burner cap and positioned directly adjacent the terminal end portion of the spark electrode for supplying the primary air/gas mixture thereto.

3. The burner assembly of claim 1 wherein the electrode aperture is of a circular configuration, the insulative support member is of a substantially cylindrical configuration defined by a larger diameter rear portion and a smaller diameter front portion, a transverse annular face between the portions, the electrode aperture being substantially of the same diameter as the front portion for receiving same therethrough and disposing the annular face in sealing engagement against an interior surface of the sidewall surrounding the electrode aperture.

4. The burner assembly of claim 3 wherein the smaller diameter front portion is substantially in the configuration of a semi-cylindrical hood enclosing the terminal end portion of the spark electrode.

5. The burner assembly of claim 1 wherein the burner ports are each of a circular configuration and include a first set of larger diameter burner ports and a second set of smaller diameter burner ports, the first set being positioned higher than the second set and, with the ports being circumferentially spaced around the sidewall in an alternating configuration.

6. A sealed gas burner assembly comprising:

a) a burner head defined by a cap and a base;

b) the cap including a vertical sidewall provided with a plurality of burner ports and an electrode aperture formed therein, and a first curved sidewall extending downwardly and outwardly from the vertical sidewall and terminating in a first circumferential edge;

c) the base including an annular rim, a second curved sidewall extending downwardly and outwardly from the annular rim and terminating in a second circumferential edge, and a cylindrical sidewall disposed inwardly of the second curved sidewall and extending downwardly from the annular rim, the cylindrical sidewall terminating in a bottom wall provided with a central aperture formed therein;

d) the cap and base being secured together at their corresponding circumferential edges to dispose the first and second curved sidewalls in overlying relationship with each other, whereby the cap and base collectively define an internal chamber therebetween; and e) a venturi member for directing a primary air and gas mixture into the internal chamber.

7. The burner assembly of claim 6 wherein the venturi member includes a venturi tube, a cylindrical tube, an annular ring positioned between the venturi and cylindrical tubes, the venturi tube extending through the central aperture of the bottom wall and being substantially fully disposed within the internal chamber, the annular ring being disposed in abutting relationship against an exterior side of the bottom wall, and means for securing the venturi member to the bottom wall.

8. The burner assembly of claim 7 wherein the cylindrical tube includes at least one aperture formed therein for admitting primary air, and further including means for varying the amount of primary air being admitted through the aperture.

9. The burner assembly of claim 6 further including an electrically insulative support member extending through the electrode aperture, the support member being provided with an electrode passageway therethrough, an electrode extending through the electrode passageway, and the electrode being provided with a terminal end portion disposed exteriorly of the burner head.

10. The burner assembly of claim 9 wherein the insulative support member is disposed in substantially fluid tight engagement with the electrode aperture to prevent the primary air/gas mixture from passing through the aperture, and an ignition port formed in the vertical sidewall of the cap, the ignition port being positioned directly adjacent the terminal end portion of the electrode for supplying the primary air/gas mixture thereto.

11. The burner assembly of claim 6 further including a range top provided with a burner opening for receiving the burner head and detachable locking means for securing the burner head to the burner opening.

12. The burner assembly of claim 11 wherein the burner opening is defined by an upstanding circular flange and the detachable locking means includes cooperating means formed in the cylindrical sidewall of the base and the upstanding circular flange to define a twist lock engagement therebetween.

13. The burner assembly of claim 12 wherein the cooperating means includes a plurality of circumferentially spaced outwardly extending first protrusions formed in the cylindrical wall and a plurality of corresponding circumferentially spaced outwardly extending second protrusions formed in the upstanding circular flange, wherein each second protrusion is defined by a vertical recess and a horizontal recess.

14. The burner assembly of claim 12 further including sealing means disposed between the burner head and the upstanding circular flange to prevent food spillovers from passing therebetween.

15. The burner assembly of claim 11 further including sealing means disposed between the burner head and the range top to prevent food spillovers from passing therebetween.

16. The burner assembly of claim 6 wherein at least the cap is provided with a heat resistant coating thereon.

17. The burner assembly of claim 16 wherein the heat resistant coating is porcelain.

18. A sealed gas burner assembly comprising:

a) a burner head including a cap and a base defining an internal chamber therebetween;

b) a spark electrode disposed within the internal chamber and provided with a terminal end portion extending outwardly of the cap;

c) a range top including a well and at least one burner opening formed in the well;

d) the burner opening being defined by an upstanding vertical flange; and e) cooperating means carried by the burner head and the upstanding vertical flange to permit a twist lock detachable engagement between the head and flange.

19. The burner assembly of claim 18 wherein the cooperating means includes a plurality of first protuberances formed in the burner head and a plurality of corresponding second protuberances formed in the flange, wherein each second protuberance is defined by a vertical recess and a horizontal recess.

20. The burner assembly of claim 18 wherein the cooperating means defines a substantially bayonet type connection between the burner head and flange.

* * * * *